US010409218B2

(12) United States Patent
Sato et al.

(10) Patent No.: US 10,409,218 B2
(45) Date of Patent: Sep. 10, 2019

(54) IMAGE FORMING APPARATUS

(71) Applicant: Konica Minolta, Inc., Chiyoda-ku, Tokyo (JP)

(72) Inventors: Yotaro Sato, Machida (JP); Nobuhiko Okano, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 37 days.

(21) Appl. No.: 15/792,488

(22) Filed: Oct. 24, 2017

(65) Prior Publication Data

US 2018/0129163 A1 May 10, 2018

(30) Foreign Application Priority Data

Nov. 4, 2016 (JP) ..... 2016-215776

(51) Int. Cl.
*G03G 21/20* (2006.01)
*G03G 15/16* (2006.01)

(52) U.S. Cl.
CPC ..... *G03G 21/206* (2013.01); *G03G 15/1605* (2013.01); *G03G 15/168* (2013.01); *G03G 21/203* (2013.01); *G03G 2215/00772* (2013.01); *G03G 2215/00776* (2013.01); *G03G 2215/1619* (2013.01)

(58) Field of Classification Search
CPC ..... G03G 15/161; G03G 15/168; G03G 15/1665; G03G 21/20; G03G 21/203; G03G 21/206; G03G 2215/00666; G03G 2215/00772; G03G 2215/00776; G03G 2215/1671
See application file for complete search history.

(56) References Cited

U.S. PATENT DOCUMENTS 10,031,475 B2 * 7/2018 Okamoto ..... G03G 21/203
2015/0110508 A1 4/2015 Nishi
2017/0336756 A1 * 11/2017 Okamoto ..... G03G 21/203

FOREIGN PATENT DOCUMENTS

JP 2002-072833 A 3/2002
JP 2006-284618 10/2006
JP 2008-292522 A 12/2008
JP 2017-075987 A 4/2017

OTHER PUBLICATIONS

JP 2006284618 English machine translation, Takatsuki, Oct. 19, 2006 (Year: 2006).*
JP 2002072833 English machine translation, Takeda et al., Mar. 12, 2002 (Year: 2002).*
Extended European Search Report dated Mar. 6, 2018, in European Patent Application No. 17194650.2, 12 pages.

* cited by examiner

*Primary Examiner* — Thomas S Giampaolo, II
(74) *Attorney, Agent, or Firm* — Squire Patton Boggs (US) LLP

(57) ABSTRACT

An image forming apparatus includes: an image supporter that supports an image to be transferred to paper; a transfer belt that is opposed to the image supporter and forms a nip; and a first heater and a second heater that heat the transfer belt, wherein, the first heater has higher performance to uniformly heat an entire area of the transfer belt than the second heater; and the second heater has higher performance to respond to a temperature change of the transfer belt in a case of output change than the first heater.

12 Claims, 5 Drawing Sheets

IMAGE FORMING APPARATUS

BACKGROUND

Technological Field

The present invention relates to image forming apparatuses.

Description of the Related Art

Recently, image forming apparatuses of a belt transfer method are known. In the belt transfer method, a transfer belt is driven so as to contact a photosensitive drum and conveys paper in synchronization with a toner image formed on the photosensitive drum. A transfer voltage having an opposite polarity (transfer polarity) of that of the electrification polarity of toner is applied to the transfer belt to transfer the toner image on the photosensitive drum to the paper side by electrostatic attractive force.

In the belt transfer method, discharge products sometimes adhere onto the transfer belt due to enduring usage of the apparatus. In a case where the apparatus is left untouched in this state for a long period of time under a high humidity environment, resistance is lowered since the adhering matters on the transfer belt absorbs moisture. Therefore, due to current leakage, an appropriate transfer electric field is not obtained. As a result, the electric field (separation electric field) generated between the transfer belt and a paper tip when the tip of the paper (dielectric substance) is separated from the photosensitive drum becomes small, and the separation performance of the paper from the photosensitive drum is lowered. Moreover, since the electric field (transfer electric field) generated when the toner image formed on the photosensitive drum is transferred to the paper also becomes small, transfer performance of toner is also lowered.

Moreover, the amount of the discharge products on the surface of the transfer belt increases depending on the amount of the voltage applied to the transfer belt. Therefore, in a case where the used amount of the transfer belt, for example, the total number of printed copies increases, separation performance and transfer performance tend to decrease.

Therefore, as a measure against moisture absorption of the photosensitive drum in a case of high humidity, a technique of installing a heater is publicly known. Similarly, a technique in which a heater is provided in the vicinity of the transfer belt to prevent the resistance decrease and current leakage caused by moisture absorption of the belt is known. For example, JP 2006-284618 A discloses a technique of installing dehumidifying heaters in the vicinity of a paper-feeding cassette and in the photosensitive drum in order to dehumidify the image forming apparatus.

However, although a sheet-shaped heater or the like can be installed on the entire inner surface of the photosensitive drum, it is difficult in the transfer belt to dispose a heater to uniformly heat the entire inner surface of the belt since a transfer roller and other stretching rollers are present even in a case where the heater is disposed on the inside of the belt. Moreover, there are also large restrictions on the space for installing the heater and on power-feed wiring. Even in a case where a heater is installed outside the belt, when the heater is in the vicinity of the belt, there is also a problem of non-uniformity in the heating state.

On the other hand, in a case where a heater is disposed at a distant position outside the belt, temperature uniformity is improved. However, since the time taken until the temperature of the transfer belt starts changing after the output of the heater is changed (responsiveness performance) becomes long, it is difficult to carry out instantaneous control to an appropriate temperature in response to various in-apparatus temperature/humidity changes such as those in warm-up, idling, differences in print mode (one side, both-side/continuous, intermittent), etc. and there is also a concern about, for example, melting of peripheral toner caused by overshoot.

In this manner, in the case in which the heater for dehumidifying the transfer belt is installed, it has been difficult to quickly, appropriately, and uniformly control the belt temperature.

SUMMARY

The present invention has been accomplished in view of the above described problems, and it is an object to provide an image forming apparatus that is capable of quickly, appropriately, and uniformly controlling a transfer belt, does not have transfer current leakage even under a high humidity environment, and is capable of ensuring good transfer performance and separation performance.

To achieve the abovementioned object, according to an aspect of the present invention, an image forming apparatus reflecting one aspect of the present invention comprises:

an image supporter that supports an image to be transferred to paper;

a transfer belt that is opposed to the image supporter and forms a nip; and a first heater and a second heater that heat the transfer belt, wherein, the first heater has higher performance to uniformly heat an entire area of the transfer belt than the second heater; and the second heater has higher performance to respond to a temperature change of the transfer belt in a case of output change than the first heater.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments according to an image forming apparatus of the present invention will be described in detail with reference to the drawings. Note that, the embodiments of the present invention are described by taking a monochrome image forming apparatus as an example, but the scope of the invention is not limited to the disclosed embodiments, and the present invention can also be applied to, for example, a color image forming apparatus.

Figure 1:
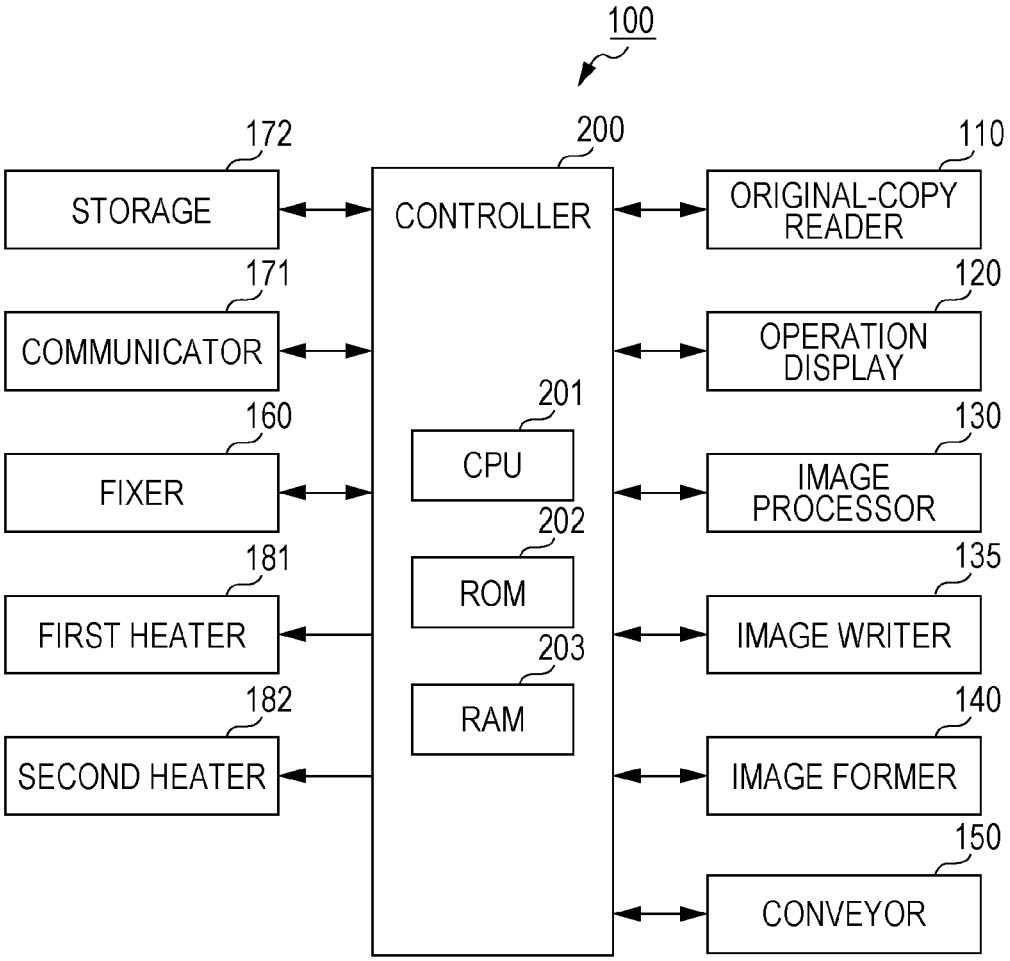
FIG. 1 is a block diagram illustrating a main functional configuration of an image forming apparatus.

FIG. 1 is a block diagram illustrating a main functional configuration of an image forming apparatus 100.

[Configuration of Image Forming Apparatus]

The image forming apparatus 100 illustrated in FIG. 1 forms an image on paper by an electrophotographic process. As illustrated in FIG. 1, the image forming apparatus 100 is provided with: an original-copy reader 110, an operation display 120, an image processor 130, an image writer 135, an image former 140, a conveyor 150, a fixer 160, a communicator 171, a storage 172, a first heater 181, a second heater 182, and a controller 200.

The controller 200 is provided with: a central processing unit (CPU) 201, a read only memory (ROM) 202, a random access memory (RAM) 203, etc. The CPU 201 reads a program, which is corresponding to processing contents, from the ROM 202, expands the program in the RAM 203, and controls operations of blocks of the image forming apparatus 100 in cooperation with the expanded program. In this process, various data stored in the storage 172 is referenced. The storage 172 includes, for example, a non-volatile semiconductor memory (so-called flash memory) or a hard disk drive.

The controller 200 transmits/receives various data to/from an external apparatus (for example, a personal computer) connected to a communication network such as a local area network (LAN), wide area network (WAN), or the like via the communicator 171. The controller 200 receives, for example, image data transmitted from the external apparatus and forms an image on paper based on the received image data. The communicator 171 includes, for example, a communication control card such as a LAN card.

The original-copy reader 110 optically scans an original copy conveyed onto a contact glass, causes the reflected light from the original copy to form an image on a light receiving surface of a charge coupled device (CCD) sensor, and reads the original copy. Note that the conveyance of the original copy onto the contact glass is carried out by an automatic document feeder (ADF), but the original copy is placed on the contact glass by hand in some cases.

The operation display 120 has a touch-panel screen. Input operations for various instructions and settings carried out by a user can be carried out via the touch-panel screen. The information of these instructions and settings is handled as job information by the controller 200. Examples of the job information include paper sizes, the number of copies to be printed, etc.

The image processor 130 includes a circuit which carries out analog/digital (A/D) conversion processes and a circuit which carries out digital image processing. The image processor 130 generates digital image data by A/D conversion processing from analog image signals acquired by the CCD sensor of the original-copy reader 110 and outputs the generated data to the image writer 135.

The image writer 135 emits laser light based on the digital image data generated by the image processor 130 and irradiates a photosensitive drum of the image former 140 with the emitted laser light, thereby forming an electrostatic latent image on the photosensitive drum (exposure process).

The image former 140 is provided with configurations for executing an electrification process carried out before the exposure process, a development process carried out after the exposure process, a transfer process after the development process, and a cleaning process after the transfer process in addition to the above described exposure process. In the electrification process, the image former 140 uniformly electrifies the surface of the photosensitive drum by a corona discharge from an electrifying device. In the development process, the image former 140 causes the toner contained in a developer in a developing device to adhere to the electrostatic latent image on the photosensitive drum, thereby forming a toner image on the photosensitive drum.

In the transfer process, the image former 140 transfers the toner image on the photosensitive drum to the paper, which is conveyed by the conveyor 150, by application of a transfer voltage from a voltage applying device. In the cleaning process, the image former 140 causes a cleaning device such as a brush to contact the photosensitive drum, thereby removing the toner remaining on the photosensitive drum after the transfer process.

The fixer 160 is provided with a fixation roller and a pressure roller. The pressure roller is disposed in a state in which the pressure roller is in pressurized-contact with the fixation roller. At the pressurized-contact of the fixation roller and the pressure roller, a fixation nip is formed. The fixer 160 applies heat and a pressure to the toner image on the paper introduced to the fixation nip (heating fixation), thereby fixing the toner image onto the paper (fixation process). As a result, the fixed toner image is formed on the paper. The paper subjected to the heating fixation by the fixer 160 is discharged to outside the image forming apparatus 100.

Figure 2:
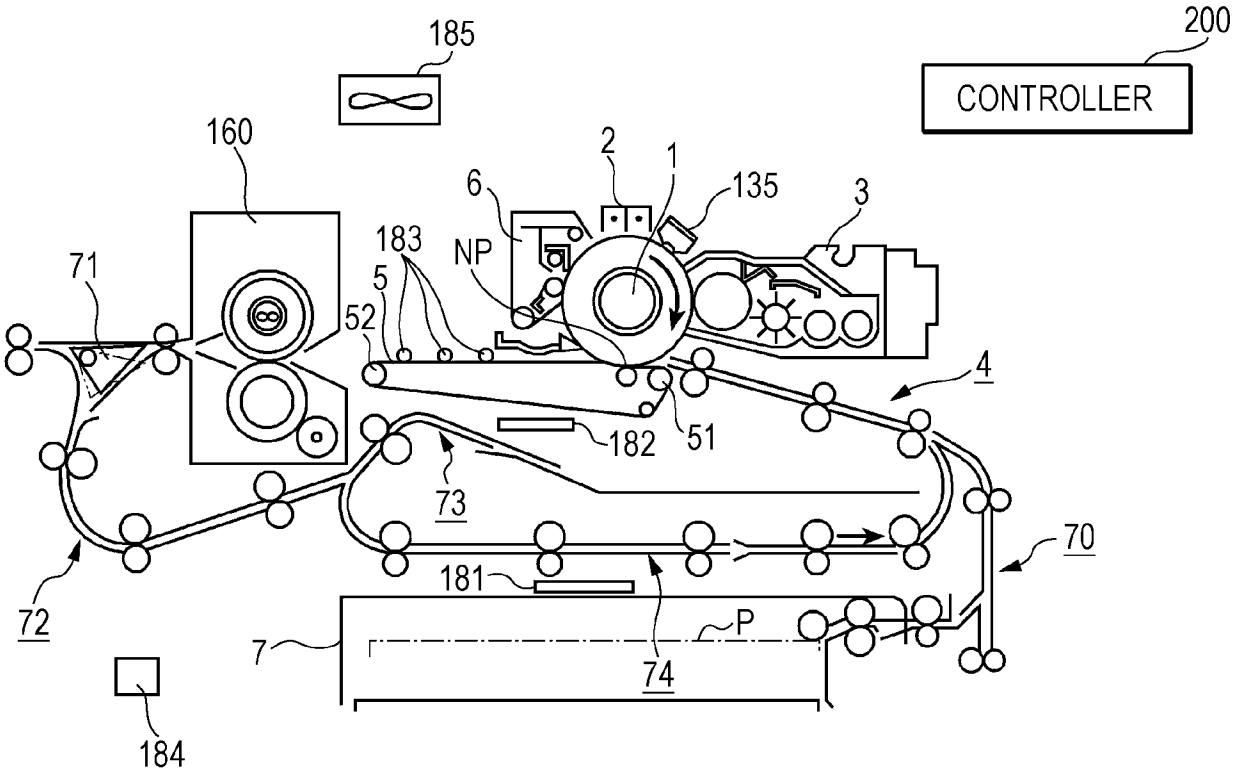
FIG. 2 is a diagram illustrating a configuration in the vicinity of an image former.

Next, with reference to FIG. 2, specific configurations around the image former 140 will be described. In FIG. 2, reference numeral 1 represents a photosensitive drum which functions as an image supporter. Along a rotation direction (the direction of an arrow) of the photosensitive drum 1, an electrifying device 2 which functions as an electrifying part, the image writer 135, a developing device 3, a transfer conveyance path 4 which leads paper P to a transfer region, a transfer belt 5 (transfer member) which transfers the toner image formed on the photosensitive drum 1 to the paper P, and a cleaning device 6 which removes the toner remaining on the photosensitive drum 1 are provided. Moreover, in the downstream of a paper conveying direction of the transfer belt 5, the fixer 160 is provided to fix the toner image of the paper P.

As the transfer belt 5, for example, a belt obtained by providing PTFE (polytetrafluoroethylene), which has a thickness of 3 [μm] as a coat layer, on a surface of a base material including chloroprene rubber or the like having a thickness of 0.5 [mm] is used. Under a predetermined environment (temperature: 20 [° C.], relative humidity: 50 [%], voltage application: 500 [V]), the transfer belt 5 has a volume resistivity of 9.5 [ $\log(=10^{9.5})\Omega\cdot\text{cm}$] and a surface resistivity of 10.5 [ $\log(=10^{10.5})\Omega/\square$].

The transfer belt 5 is stretched among a driven roller 51, a driving roller 52, and other rollers and is disposed below the photosensitive drum 1 such that the surface of the transfer belt 5 contacts part of the outer peripheral surface of the photosensitive drum 1. More specifically, a nip NP serving as a transfer region is formed between the transfer belt 5 and the photosensitive drum 1. At the nip NP, the paper P is conveyed while the paper is pressed against the photosensitive drum 1 by the transfer belt 5.

When a positive transfer voltage is applied to the transfer belt 5, a negative toner image on the photosensitive drum 1 is transferred to the paper P, which is in contact with the photosensitive drum 1.

The first heater 181 and the second heater 182 heat the transfer belt 5 under control of the controller 200. The first heater 181 is disposed at a position more distant from the transfer belt 5 than the second heater 182 is. Specifically, with respect to a diameter L of the transfer belt 5, the shortest distance from the first heater 181 to the transfer belt 5 is desired to be equal to or more than L, and the shortest distance from the second heater 182 to the transfer belt 5 is desired to be the distance which is equal to or less than 2L/3. Note that the diameter L of the transfer belt 5 is the diameter of a true circle in a case where the cross section of the transfer belt 5 in the axial directions of the rollers is assumed to be the true circle, and the diameter L is the value obtained by dividing the length of the entire perimeter of the transfer belt 5 by pi.

In the present embodiment, the first heater is disposed on a main-body bottom plate of the image forming apparatus 100, and the second heater is disposed immediately below the transfer belt 5.

The output of the first heater 181 is larger than the output of the second heater 182. As described later, the controller 200 independently controls the outputs of the first heater 181 and the second heater 182 depending on the detection results of temperature detecting devices 183 and a humidity detecting device 184.

The temperature detecting devices 183 are temperature sensors which can detect vicinity temperatures of the transfer belt 5. Note that the vicinity temperatures of the transfer belt 5 include surface temperatures of the transfer belt 5. In the present embodiment, the temperature detecting devices 183 are disposed at a plurality of locations on the surface of the transfer belt 5 and detect the surface temperatures of the transfer belt 5. However, as long as the later-described heating control of the transfer belt 5 can be carried out, the temperature detecting devices 183 may be configured to detect the temperatures of the positions which are somewhat distant from the transfer belt 5.

The humidity detecting device 184 is a hygrometer installed in a lower part of the image former 140 as illustrated in FIG. 2 and can detect the humidity outside the apparatus or in the apparatus.

The paper P is housed in the paper-feeding cassette 7 and is supplied to the transfer conveyance path 4 through a paper-feeding conveyance path 70. A gate 71 is provided in the downstream of the fixer 160 and carries out switching between a case in which the paper P is discharged to outside and a case in which the paper P is fed to a both-side conveyance path 72 for both-side printing. The paper P which has entered the both-side conveyance path 72 once proceeds to an inverting conveyance path 73, is inverted therein, and joins the transfer conveyance path 4 from a re-paper-feeding conveyance path 74.

Hereinabove, the configurations of the image forming apparatus 100 have been described. Hereinafter, a control method of the image forming apparatus 100 will be described.

[Control Method of Image Forming Apparatus 100]

Figure 5:
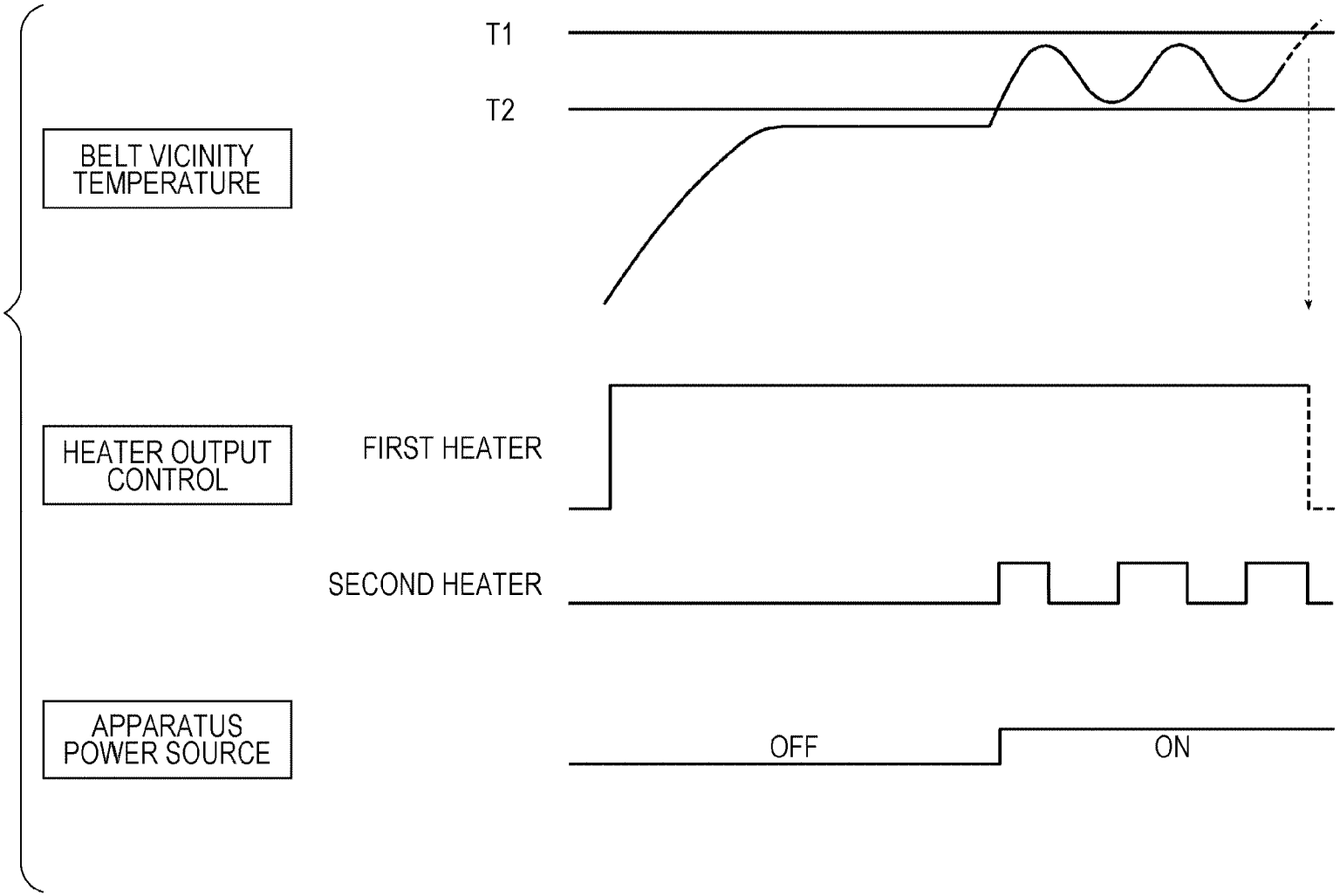
FIG. 5 is a diagram illustrating the idea of an embodiment of the present invention.

The image forming apparatus 100 according to the present embodiment carries out heating control by using the two heaters having different outputs such that the surface temperature T of the transfer belt 5 is within a predetermined temperature range $T2 \leq T \leq T1$. FIG. 5 is a diagram illustrating the idea of the heating control of the transfer belt 5 according to the present embodiment.

Compared with the second heater 182, the first heater 181 has a larger output and is disposed at a more distant position from the transfer belt 5. Electricity is distributed to the first heater 181 both in the cases in which a power source of the image forming apparatus 100 is on and off. By virtue of this, as illustrated in FIG. 5, the surface temperature of the transfer belt 5 is uniformly raised to the vicinity of T2 such that a temperature level can be maintained.

On the other hand, the second heater 182 is positioned in the vicinity of the transfer belt 5 and heats the transfer belt 5 with the smaller output compared with that of the first heater 181. Electricity is distributed to the second heater 182 only when the power source of the image forming apparatus 100 is on. While the first heater 181 has a fixed output, the second heater 182 is subjected to output adjustment depending on the in-apparatus temperature/humidity. More specifically, in a case where $T<T2$ is satisfied when the power source of the image forming apparatus 100 is on, the power sources of both of the first heater 181 and the second heater 182 are turned on to heat the transfer belt 5. In a case where $T2 \leq T \leq T1$ is satisfied, the power source of only the first heater 181 is turned on, and the power source of the second heater 182 is turned off. By virtue of this, responses to in-apparatus temperature/humidity variations of the image forming apparatus 100 can be quickly made, and control can be carried out so as to satisfy $T2 \leq T \leq T1$.

Note that, in a case where $T1<T$ is satisfied, both of the first heater 181 and the second heater 182 are turned off, thereby preventing overheating of the transfer belt 5.

Next, transfer-belt heating control in the image forming apparatus 100 according to the present embodiment will be described by using a flow chart of FIG. 3.

First, when the power source of the image forming apparatus 100 is turned on (step S301), the controller 200 functions as counting means and counts the number of printed copies (step S302). On the surface of the transfer belt 5, discharge products are accumulated depending on the amount of the applied voltages. Therefore, the accumulated amount of the discharge products can be predicted from the used amount of the transfer belt 5. Therefore, in the present embodiment, a threshold value is provided for the number of printed copies; and, when the number reaches a predetermined number of printed copies, the heating control of the transfer belt 5 is carried out. Note that the threshold value of the number of printed copies is set in advance and is stored by the storage 172.

The controller 200 determines whether the number of printed copies has reached a predetermined amount or not (step S303). In a case where the controller 200 determines that the number has not reached the predetermined amount (step S303: No), a transition to step S316 is made. However, in a case where the controller 200 determines that the number has reached the predetermined amount (step S303: Yes), the process proceeds to step S304.

In step S304, the controller 200 references the humidity outside the apparatus detected by the humidity detecting device 184. In step S305, the controller 200 causes the temperature detecting device 183 to detect the surface temperature T of the transfer belt 5. The controller 200 calculates absolute humidity H based on the detected humidity and the temperature T (step S306). Then, the controller 200 determines whether H exceeds a threshold value H1 of absolute humidity or not (step S307). In a case where the controller 200 determines that H does not exceed H1 (step S307: No), the controller finishes the control. However, in a case where the controller 200 determines that H exceeds H1 (step S307: Yes), a transition to step S308 is made.

In step S308, the controller 200 determines whether $T<T2$ is satisfied or not (step S308). Herein, T2 is a second threshold value. In a case where the controller 200 determines that T is lower than T2 (step S308: Yes), the controller 200 functions as control means and turns on the first heater 181 and the second heater 182 (step S309).

In a case where the controller 200 determines that T is not lower than T2 (step S308: No), the controller 200 determines whether T2≤T≤T1 is satisfied or not (step S310). Herein, T1 is a first threshold value and satisfies T2<T1. In a case where the controller 200 determines that T2≤T≤T1 is satisfied (step S310: Yes), the controller 200 turns on the first heater 181 and turns off the second heater 182 (step S311). In a case where the controller 200 determines that T2≤T≤T1 is not satisfied (step S310: No), in other words, determines that T1<T is satisfied, the controller 200 turns off the first heater 181 and the second heater 182 (step S312).

Subsequently, in step S313, the controller 200 determines whether the power source of the image forming apparatus 100 has been turned off or not. In a case where the controller 200 determines that the power source of the image forming apparatus 100 has been turned off, the process makes a transition to the heating control of the case in the flow chart of FIG. 4 in which the power source is off.

In a case where the controller 200 determines that the power source of the image forming apparatus 100 has not been turned off (step S313: No), the controller 200 determines whether predetermined time has elapsed or not (step S314). The controller 200 measures the time from the process of step S308 and changes the heating conditions by the heaters every time when the predetermined time elapses. In a case where the controller 200 determines that the predetermined time has elapsed (step S314: Yes), the process returns to step S308 and repeats the heating control of the transfer belt by the heaters. However, in a case where the controller 200 determines that the predetermined time has not elapsed (step S314: No), the process returns to step S313.

Note that, in step S303, in a case where the controller 200 has determined that the printed amount has not reached the predetermined amount (step S303: No), the controller 200 determines whether the printing has been finished or not (step S316). In a case where the controller 200 determines that the printing has not been finished (step S316: No), the process returns to step S303. However, in a case where the controller 200 determines that the printing has been finished (step S316: Yes), the control is finished. In other words, in a case where the printed amount does not reach the predetermined amount, it is determined that the amount of the discharge products which have adhered to the transfer belt 5 is small; and, in a case where the humidity outside the apparatus is sufficiently low, the transfer-belt heating control is not carried out.

The heating control of the case in which the power source of the image forming apparatus 100 is off will be described by using the flow chart of FIG. 4.

In a case where the power source of the image forming apparatus 100 is turned off, the controller 200 turns on the first heater 181 and turns off the second heater 182 (step S401). Then, the controller 200 determines whether T1<T is satisfied or not (step S402). In a case where the controller 200 determines that T1<T is satisfied (step S402: Yes), the controller 200 turns off both of the first heater 181 and the second heater 182 (step S403), and the process makes a transition to step S405.

In a case where the controller 200 determines that T1<T is not satisfied (step S402: No), the controller 200 determines whether the power source of the image forming apparatus 100 has been turned on or not (step S404). In a case where the controller 200 determines that the power source is on (step S404: Yes), the process makes a transition to step S302 of the flow chart of FIG. 3. In a case where the controller 200 determines that the power source is not on (step S404: No), the process returns to step S402.

In step S405, the controller 200 determines whether the temperature T satisfies T≤T1 or not. In a case where the controller 200 determines that T≤T1 is satisfied (step S405: Yes), the process returns to step S401. However, in a case where the controller 200 determines that T≤T1 is not satisfied (step S405: No), the controller 200 determines whether the power source of the image forming apparatus 100 has been turned on or not (step S406). In a case where the controller 200 determines that the power source of the image forming apparatus 100 is on (step S406: Yes), the process makes a transition to step S302 of the flow chart of FIG. 3. In a case where the controller 200 determines that the power source of the image forming apparatus 100 is not on (step S406: No), the process returns to step S405.

As described above, the image forming apparatus 100 according to the present embodiment uses the two heaters, i.e., the first heater 181, which has the large output and is disposed at the position distant from the transfer belt 5, and the second heater 182, which has a smaller output than the first heater 181 and is disposed in the vicinity of the transfer belt 5. The temperature of the transfer belt 5 can be uniformly maintained by the first heater 181, and, corresponding to the temperature/humidity changes in the apparatus, the temperature of the transfer belt 5 can be adjusted in a short period of time by the second heater 182. By virtue of this, even under a high humidity environment, transfer current leakage can be suppressed, and good transfer performance and separation performance can be ensured.

Moreover, in the present embodiment, in a case where the power source of the image forming apparatus 100 is turned off, electricity is distributed only to the first heater 181. By virtue of this, the surface temperature of the transfer belt 5 can be always maintained around an appropriate temperature, and, when the power source of the image forming apparatus 100 is turned on, a quick response can be made.

Moreover, in the present embodiment, in a case where the humidity outside the apparatus is lower than the predetermined absolute humidity H1, in other words, under a low-humidity environment, the heating control by the heaters is not carried out. By virtue of this, unnecessary heating control can be suppressed, and electric power consumption can be reduced.

Note that, in the present embodiment, the transfer belt 5 may be rotated when the second heater 182 is on. The unevenness in the surface temperature of the transfer belt 5 can be suppressed by shifting phases while repeating continuous rotations or rotation/stop little by little. Moreover, during the rotations, the transfer belt 5 may be brought into contact with the photosensitive drum 1 with a pressure to the photosensitive drum 1 such that the photosensitive drum 1 is driven and rotated.

Also, a fan 185 serving as a blower which circulates the air around the transfer belt 5 may be actuated when the second heater 182 is on. Also by virtue of this, the unevenness in the surface temperature of the transfer belt 5 can be suppressed.

Moreover, in an employable configuration, T3 which has a smaller value than T2 is provided as a third threshold value, and, in a case where the surface temperature of the transfer belt 5 is lower than T3, the controller 200 actuates the fan 185 to blow air from the heaters toward the transfer belt 5. By virtue of this, the heating efficiency of the transfer belt 5 can be improved.

Note that, the present embodiment employs the configuration in which the two heaters having different outputs are disposed at the positions having different distances from the transfer belt 5. However, the configuration is not limited thereto as long as the two performances, i.e., uniform heating performance and responsiveness are provided.

For example, also by controlling the directionality of heat conduction or heat distribution by disposing a heat reflecting plate(s) or a heat shielding plate(s), by providing a member(s) having high heat conductivity between the heaters and the transfer belt 5, or by controlling the flow of wind by the fan 185, uniform heating performance and responsiveness can be controlled, and the effects of the present invention can be obtained.

Hereinabove, specific descriptions have been given based on the examples according to the present invention. However, detailed configurations of the devices constituting the image forming apparatus and detailed operations of the devices can be also arbitrarily changed within the range not departing from the gist of the present invention.

EXAMPLES

Experimental Results

In the end, the results of Experiment 1 and Experiment 2 carried out by the present inventors for confirming effectiveness of the present invention will be described will be described.

The experiments were carried out with transfer-belt dehumidifying heaters and an output control mechanism thereof installed in a machine: bizhub PRESS 1250. As illustrated in FIG. 2, the first heater 181 was installed on the main-body bottom plate of the image forming apparatus 100, and the second heater 182 was installed immediately below the transfer belt 5 to carry out the experiments.

Experiment 1

Experiment 1 is the heating control of the transfer belt 5 in the case in which the power source of the image forming apparatus 100 is on.

Figure 3:
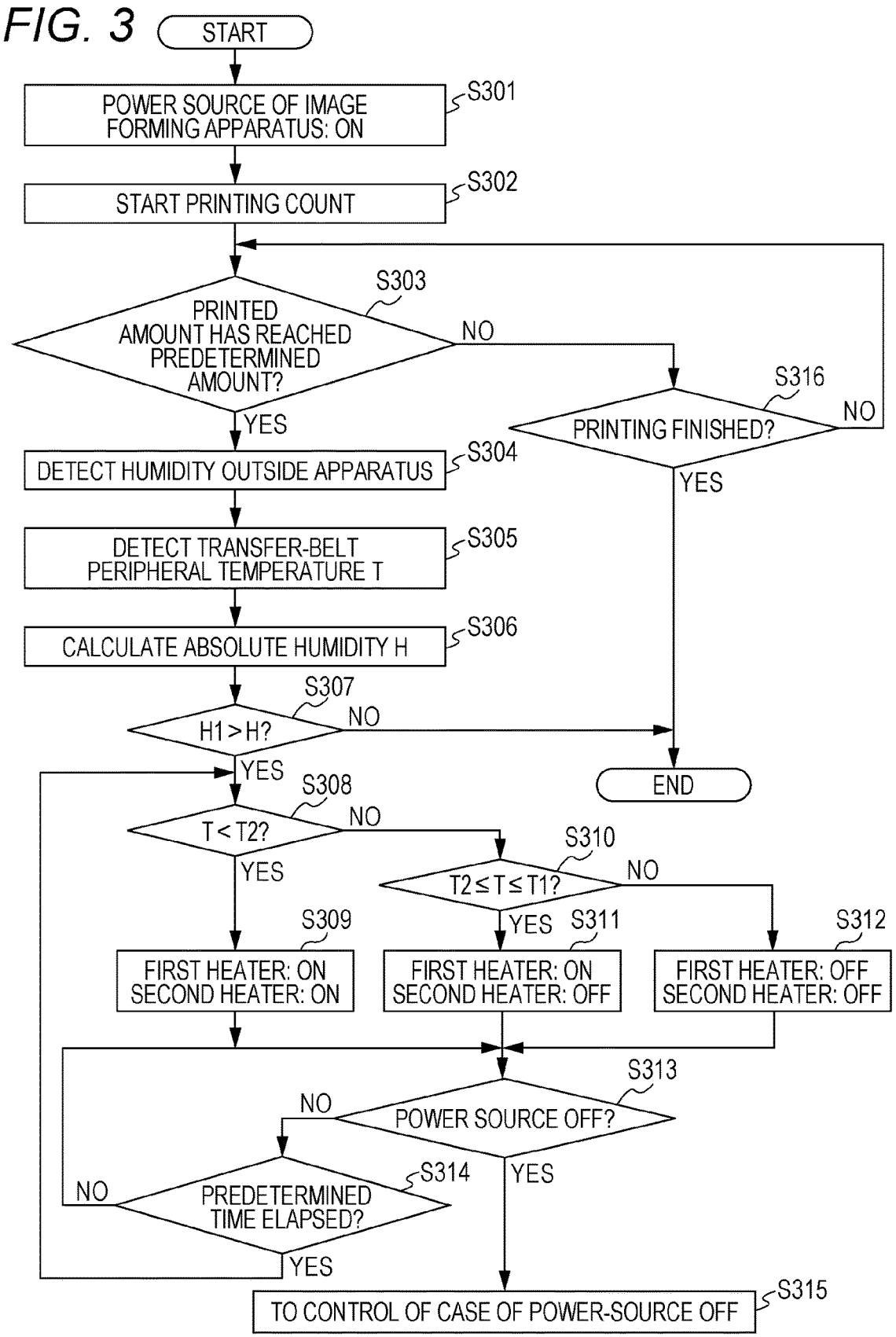
FIG. 3 is a flow chart illustrating an example of operation of the image forming apparatus.
Figure 4:
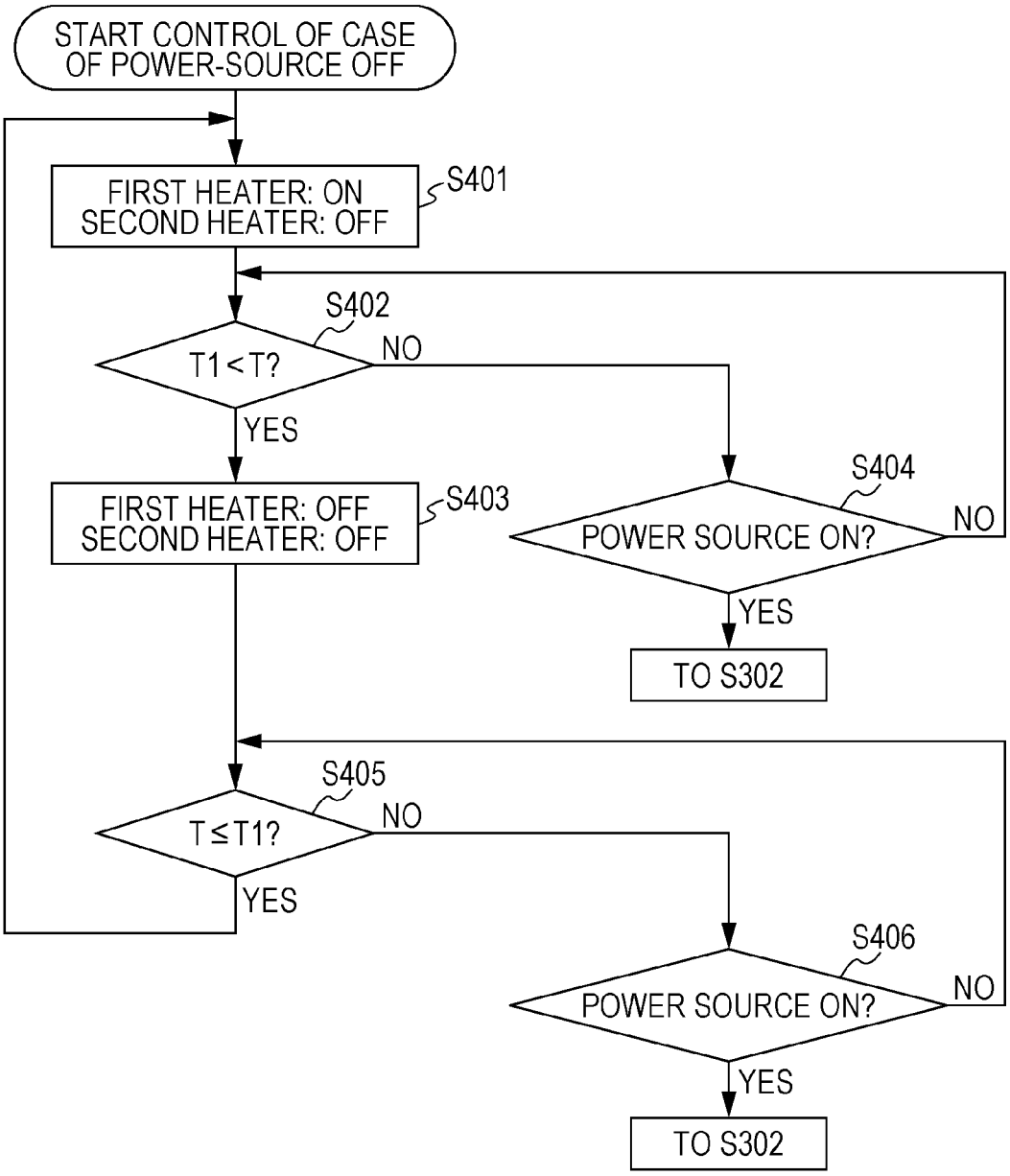
FIG. 4 is a flow chart illustrating an example of operation of the image forming apparatus.

The experiment was carried out at a temperature of 30° C. under a high humidity environment in which relative humidity was 80% (absolute humidity was about 2400 [$\times 10^{-2}$ g/m$^3$], and a detailed control method followed the flow charts of FIG. 3 and FIG. 4. The experiment was carried out under the conditions, i.e., T1: 43° C., T2: 38° C., H1: absolute humidity of 15 g/m$^3$, and the threshold value of the number of printed copies: 500,000 copies. Note that, in the present example, the temperature detecting devices 183 were installed at 15 locations on the transfer belt 5 to detect the surface temperatures of the transfer belt 5.

The temperature characteristics, transfer performance, and separation performance of the transfer belt were evaluated in each of the states of: A: immediately after warm-up, B: after 10,000 one-side copies, C: after 10,000 both-side copies, and D: one hour after without touching (electric-power-consumption saving mode). Five hundred sheets of paper having a basis weight of 40 g/m$^2$ were printed, and evaluation was carried out for the presence/absence of occurrence of photosensitive drum separation jamming and for the concentration of solid black images.

In Examples 1 to 5, the heating control of the transfer belt 5 was carried out with both of the first heater 181 and the second heater 182, and the distances from the transfer belt 5 to the first heater 181 and the second heater 182 were different. In each case, during output of the second heater 182, the air in the vicinity of the transfer belt 5 was circulated by the fan 185, and the transfer belt 5 was rotated.

In Comparative Example 1, the heating control of the transfer belt 5 was carried out with both of the first heater 181 and the second heater 182, and the second heater 182 was disposed at a position more distant from the transfer belt 5 than the first heater 181 was.

In Comparative Example 2, the heating control of the transfer belt 5 was carried out with both of the first heater 181 and the second heater 182, and the output of the second heater 182 was larger than the output of the first heater 181.

In Comparative Example 3, heating control was carried out only with the second heater 182.

In Comparative Example 4, heating control was carried out only with the second heater 182, and the output of the second heater 182 was larger than that of Comparative Example 3.

In Comparative Example 5, heating control was carried out only with the first heater 181.

In Comparative Example 6, heating control was carried out only with the first heater 181, and the output of the first heater 181 was larger than that of Comparative Example 5.

In Comparative Example 7, heating control was carried out only with the first heater 181, and the output thereof was controlled depending on the temperature in the vicinity of the transfer belt 5.

Table 1 is a table indicating the control conditions of the heaters and evaluation results in Experiment 1. Evaluation methods are as described below. Temperature Controllability: the difference between a target temperature and an actually measured temperature of the belt and the time taken to reach a target temperature area were comprehensively evaluated by ⊙ to x.

Temperature Uniformity: ⊙: temperature variations among 15 locations at the belt surface were less than 5° C., ○: the variations were less than 5° C. to 7° C., and x: the variations were equal to or more than 7° C.

Transfer Performance: ⊙: absolute concentration was equal to or more than 1.3 and concentration differences within a page and among pages were less than 0.1, ○: absolute concentration was equal to or more than 1.3 and concentration differences within a page and among pages were less than 0.1 to 0.15, and x: absolute concentration was less than 1.3 and concentration differences within a page and among pages were equal to or more than 0.15.

Separation Performance ⊙: no separation jamming, ○: separation jamming was less than 0.5%, Δ: separation jamming was less than 0.5 to 1%, and x: separation jamming was equal to or more than 1%.

TABLE 1

| | Heater Configuration and Output | | | | | | Results | | | |
|---|---|---|---|---|---|---|---|---|---|---|
| | First Heater | | | Second Heater | | | Belt Temperature | | Quality | |
| | Distance to Belt | Electric Power | Control | Distance to Belt | Electric Power | Control | Control-lability | Uniformity | Transfer Performance | Separation Performance |
| Example 1 | 200 mm | 30 W | Fixed Output | 50 mm | OFF to 10 W | Output Control | ⊙ | ⊙ | ⊙ | ⊙ |
| Example 2 | 160 mm | 30 W | Fixed Output | 50 mm | OFF to 10 W | Output Control | ⊙ | ⊙ | ⊙ | ⊙ |
| Example 3 | 200 mm | 30 W | Fixed Output | 90 mm | OFF to 10 W | Output Control | ⊙ | ⊙ | ⊙ | ⊙ |
| Example 4 | 120 mm | 30 W | Fixed Output | 50 mm | OFF to 10 W | Output Control | ⊙ | ○ | ○ | ○ |
| Example 5 | 200 mm | 30 W | Fixed Output | 130 mm | OFF to 10 W | Output Control | ○ | ⊙ | ○ | ○ |
| Comparative Example 1 | 120 mm | 30 W | Fixed Output | 140 mm | OFF to 10 W | Output Control | X | X | X | X |
| Comparative Example 2 | 200 mm | 15 W | Fixed Output | 50 mm | OFF or 30 W | Output Control | X | X | X | X |
| Comparative Example 3 | | OFF | | 50 mm | OFF to 10 W | Output Control | X | ⊙ | X | X |
| Comparative Example 4 | | | | 50 mm | OFF to 20 W | Output Control | ⊙ | X | X | Δ |
| Comparative Example 5 | 200 mm | 30 W | Fixed Output | | OFF | | X | ⊙ | X | X |
| Comparative Example 6 | 200 mm | 40 W | Fixed Output | | | | X | ⊙ | ⊙ | ⊙ |
| Comparative Example 7 | 200 mm | 40 W | Output Control | | | | X | ⊙ | X | X |

Hereinafter, experimental results will be described.

In Examples 1 to 5, the in-apparatus temperature/humidity were variously changed in warm-up, in idling, and depending on conditions such as differences (one-side/both-side) of print modes; however, since the first heater 181 and the second heater 182 were controlled in the manner of FIG. 5, the belt temperature can be appropriately and uniformly controlled, and good transfer performance and separation performance were obtained under any of the conditions of A to D.

In order to uniformize the temperatures of the transfer belt 5, the shortest distance from the first heater 181 to the transfer belt 5 is preferred to be equal to or more than the diameter L (about 150 mm in the present experiment) of the transfer belt 5. In order to carry out the temperature control well, the shortest distance from the second heater 182 to the transfer belt 5 is preferred to be equal to or less than 2L/3.

In Comparative Example 1, the second heater 182, which carries out output control depending on the belt surface temperature, was at the position more distant from the transfer belt 5 than the first heater 181 of the fixed output was, all of the controllability and uniformity of the temperatures of the transfer belt 5 were not good, and defective transfer and defective separation occurred.

In Comparative Example 2, the output of the first heater 181 was small, and the output of the second heater 182 was large; therefore, appropriate and uniform control of the belt temperatures was not carried out, and transfer unevenness and defective separation occurred.

In Comparative Example 3, since the electric power of the second heater 182 was small, the transfer belt 5 was not sufficiently heated, and defective transfer and defective separation occurred due to transfer current leakage.

In Comparative Example 4, the electric power of the second heater 182 was sufficient. However, since the heater was close to the transfer belt 5, the transfer belt 5 was not sufficiently heated, resistance unevenness depending on the locations of the transfer belt 5 was generated, and, as a result, transfer unevenness and defective separation occurred.

In Comparative Example 5, since the electric power of the first heater 181 was small, the transfer belt 5 was not sufficiently heated, and defective transfer and defective separation occurred.

In Comparative Example 6, since the electric power of the first heater 181 was large, the temperature of the cleaning device 6 was increased, and, as a result, packing of toner occurred.

In Comparative Example 7, although the output of the first heater 181 was controlled, variations in the belt temperatures along with time were large, and variations in image concentration and defective separation occurred.

Experiment 2

Experiment 2 is the heating control of the transfer belt 5 in the case in which the power source of the image forming apparatus 100 is off. As well as Experiment 1, Experiment 2 is carried out under a high humidity environment, and printing conditions are also similar to those of Experiment 1.

In Example 6, the second heater 182 was off, and only the first heater 181 used a fixed output.

In Comparative Example 8, the two heaters, i.e., the first heater 181 and the second heater 182 used fixed outputs.

Note that, both in Example 6 and Comparative Example 8, the distances from the first heater 181 and the second heater 182 to the transfer belt 5 were 200 mm and 50 mm, respectively.

Table 2 is a table indicating the control conditions of the heaters and evaluation results in Experiment 2. Evaluation methods are similar to those of Experiment 1.

TABLE 2

| | Heater Configuration and Output | | | | Results | | | |
|---|---|---|---|---|---|---|---|---|
| | | | | | Belt | | | |
| | First Heater | | Second Heater | | Temperature | | Quality | |
| | Electric Power | Control | Electric Power | Control | Control-lability | Uniformity | Transfer Performance | Separation Performance |
| Example 6 | 40 W | Fixed Output | OFF | | ⊙ | ⊙ | ⊙ | ⊙ |
| Comparative Example 8 | 40 W | Fixed Output | 10 W | Fixed Output | ⊙ | X | X | Δ |

Hereinafter, experimental results will be described.

In Example 6, the second heater 182 was off, and only the first heater 181 had the fixed output; as a result, the belt was uniformly heated, and good transfer performance and separation performance were obtained.

In Comparative Example 8, the two heaters, i.e., the first heater 181 and the second heater 182 had the fixed outputs, in which, since the second heater 182 continued outputting in the state in which there was no replacement of air by the fan 185 and no rotation of the transfer belt 5, the surface temperatures of the transfer belt 5 became non-uniform, and transfer unevenness and defective separation occurred.

As described above, according to Experiment 1 and Experiment 2, the surface temperatures of the transfer belt 5 can be appropriately and uniformly maintained by the heating control of the transfer belt 5 according to the present invention. By virtue of this, it was confirmed that, even under a high humidity environment, good transfer performance and separation performance were ensured without transfer current leakage.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an image supporter that supports an image to be transferred to paper;

a transfer belt that is opposed to the image supporter and forms a nip;

a first heater and a second heater that heat the transfer belt, wherein, the first heater is configured and controlled to uniformly heat an entire area of the transfer belt, and the second heater is configured and controlled to respond to a temperature change of the transfer belt;

the image forming apparatus further comprising:

a temperature detector that is capable of detecting a vicinity temperature of the transfer belt; and a hardware processor that controls actuation of the first heater and the second heater, wherein the hardware processor independently controls the actuation of the first heater and the second heater such that the vicinity temperature of the transfer belt is within a temperature range between a first threshold value and a second threshold value having a smaller value than the first threshold value;

in a case where the vicinity temperature of the transfer belt is lower than the second threshold value, the first heater and the second heater are actuated;

in a case where the vicinity temperature is equal to or higher than the second threshold value and equal to or lower than the first threshold value, only the first heater is actuated; and, in a case where the vicinity temperature is higher than the first threshold value, both of the first heater and the second heater are not actuated.

2. The image forming apparatus according to claim 1, wherein the first heater is disposed at a position at which a distance between the first heater and the transfer belt is larger than a distance between the second heater and the transfer belt.

3. The image forming apparatus according to claim 1, wherein the output of the first heater is larger than the output of the second heater.

4. The image forming apparatus according to claim 1, wherein, while a power source of the image forming apparatus is on, the hardware processor fixes the output of the first heater and adjusts the output of the second heater depending on the vicinity temperature of the transfer belt.

5. The image forming apparatus according to claim 1, wherein, while a power source of the image forming apparatus is off, the hardware processor carries out control such that the first heater is actuated and the second heater is not actuated.

6. The image forming apparatus according to claim 5, wherein, while the power source of the image forming apparatus is off, the hardware processor carries out control such that, in a case where the vicinity temperature of the transfer belt is higher than the first threshold value, the first heater is not actuated.

7. The image forming apparatus according to claim 1, further comprising a humidity detector that is capable of detecting humidity outside the apparatus, wherein the hardware processor carries out control such that, in a case where the humidity outside the apparatus is lower than a predetermined humidity while the power source of the image forming apparatus is on, both of the first heater and the second heater are not actuated.

8. The image forming apparatus according to claim 1, further comprising a counter that counts the number of printed copies, wherein, in a case where the number of printed copies is less than a predetermined number while the power source of the image forming apparatus is on, the hardware processor carries out control such that both of the first heater and the second heater are not actuated.

9. The image forming apparatus according to claim 1, further comprising a rotation controller that controls rotation of the transfer belt, wherein, in a case where the second heater is being actuated, the rotation controller rotates the transfer belt.

10. The image forming apparatus according to claim 9, wherein, when the transfer belt is rotated, the rotation controller causes the transfer belt to be in contact with the image supporter with a pressure such that the image supporter is driven and rotated.

11. The image forming apparatus according to claim 1, further comprising a blower that blows air to the transfer belt; and a blowing controller that controls the blower, wherein, in a case where the second heater is being actuated, the blowing controller actuates the blower to circulate the air around the transfer belt.

12. The image forming apparatus according to claim 11, wherein, in a case where the vicinity temperature of the transfer belt is lower than a third threshold value that is a value smaller than the second threshold value, the blowing controller carries out control such that the blower blows air from the first heater or the second heater toward the transfer belt and carries out control such that the air blown from the first heater or the second heater toward the transfer belt is not outside air.

* * * * *